US006135421A

United States Patent [19]

Bartelme et al.

[11] Patent Number: 6,135,421

[45] Date of Patent: Oct. 24, 2000

[54] HOIST WITH PROXIMITY LIMIT SWITCHES

[75] Inventors: Phillip J. Bartelme, West Allis; Neal W. Becker, Greenfield, both of Wis.

[73] Assignee: MHE Technologies, Inc., Wilmington, Del.

[21] Appl. No.: 09/429,715

[22] Filed: Oct. 29, 1999

[51] Int. Cl.[7] ..... B66D 1/48

[52] U.S. Cl. ..... 254/268; 254/276

[58] Field of Search ..... 254/268, 276, 254/269, 278, 375; 242/370, 563.1, 563, 912, 480.1, 485, 485.1, 485.6

[56] References Cited

U.S. PATENT DOCUMENTS

| | | | |
|---|---|---|---|
| 1,163,165 | 12/1915 | Mueller . | |
| 1,369,147 | 2/1921 | Valls | 254/269 |
| 1,670,918 | 5/1928 | Weingartner | 254/276 |
| 1,788,302 | 1/1931 | Hummel | 254/276 |
| 2,502,710 | 4/1950 | Duncan | 254/173 |
| 2,558,517 | 6/1951 | Handleman | 254/269 |
| 2,661,405 | 12/1953 | Western | 254/269 |
| 2,683,020 | 7/1954 | Nickle | 254/173 |
| 3,042,375 | 7/1962 | Fahey et al. | 254/269 |
| 3,677,520 | 7/1972 | Koomey | 254/173 |
| 3,850,380 | 11/1974 | Kranefeld | 242/54 |
| 3,960,362 | 6/1976 | Griffiths et al. | 254/276 |
| 4,636,962 | 1/1987 | Broyden et al. | 364/478 |
| 4,905,849 | 3/1990 | Coull | 254/269 |
| 5,405,027 | 4/1995 | Plass | 254/269 |
| 5,492,306 | 2/1996 | Zaguroli, Jr. | 254/268 |
| 5,803,437 | 9/1998 | Paterson et al. | 254/276 |

FOREIGN PATENT DOCUMENTS

| | | | |
|---|---|---|---|
| 1144966 | 3/1985 | U.S.S.R. | 254/276 |
| 258762 | 9/1926 | United Kingdom | 254/276 |

*Primary Examiner*—Donald P. Walsh
*Assistant Examiner*—Emmanuel M. Marcelo
*Attorney, Agent, or Firm*—Michael Best & Friedrich LLP

[57] ABSTRACT

A hoist apparatus comprising a frame, a hoist drum mounted on the frame for rotation about a drum axis, a motor connected to the drum for selectively rotating the drum in opposite wind-up and wind-off directions about the drum axis, a hoist rope wound around the drum such that the rope winds on to and off of the drum in response to rotation of the drum in the wind-up and wind-off directions, respectively, the rope having a maximum wind-up point beyond which it is not desirable to wind a significant amount of rope on to the drum, and a proximity switch mounted on the frame adjacent the drum such that the drum moves relative to the switch, the switch being capable of sensing the presence of the rope without touching the rope, and the switch preventing the motor from rotating the drum in the wind-up direction when the switch senses the presence of the rope on the drum at the maximum wind-up point.

19 Claims, 1 Drawing Sheet

HOIST WITH PROXIMITY LIMIT SWITCHES

BACKGROUND OF THE INVENTION

The invention relates to hoist apparatus, and more particularly to devices for limiting the rotation of a hoist drum beyond a desired position.

A conventional hoist apparatus includes a hoist drum, a motor for selectively rotating the drum, and a hoist rope wound around the drum such that the rope winds on to and off of the drum in response to rotation of the drum in opposite directions. Typically, the rope is a wire rope and the drum has a helical groove in which the rope is reeved as the rope winds on to the drum. A bottom block is supported by the rope such that the bottom block moves up and down as the rope winds on to and off of the drum.

In order to prevent a load or the bottom block from being raised too high, to prevent the rope from paying out too far (such that it could wrap around the drum the opposite way), or to prevent the load from being lowered too low, it is known to provide a limit switch for preventing the rope from being wound too far on to or off of the drum. Such a switch can be, for example, a geared limit switch. Other types of limit switches are disclosed in U.S. Pat. Nos. 3,850,380 and 5,405,027.

SUMMARY OF THE INVENTION

The invention provides an improved limit switch for preventing unwanted hoist drum rotation. The switch is a proximity switch that eliminates the difficulty associated with a geared limit switch setup.

More particularly, the invention provides a proximity switch adjustably fixed or mounted on the hoist frame adjacent the drum such that the drum moves (rotates) relative to the switch. The switch is a known type that is capable of sensing the presence of the rope without touching the rope (hence the term "proximity"). The switch is operable, preferably via the hoist control, to prevent the motor from rotating the drum in a given direction when the switch senses the presence or absence of the rope, depending on the direction of drum rotation. If the rope is being wound on to the drum properly, the point at which the rope leaves the drum groove is always the same when a selected length of rope is wound on to the drum. It is therefore possible to have the switch "look for" the rope at a certain point in the groove or along the drum. If the switch is preventing the rope from winding too far on to the drum, the switch stops the drum in response to the presence of the rope at a selected position in the drum groove. If the switch is preventing the rope from winding too far off of the drum, the switch stops the drum in response to the absence of the rope at a different selected position in the drum groove.

In the preferred embodiment of the invention, the hoist has an upper proximity limit switch that signals the motor control to stop winding the rope on to the drum when the switch senses the presence of the rope at a certain position in the drum groove, i.e., when it is not desirable to wind more rope on to the drum. The hoist also has a lower proximity limit switch that signals the motor control to stop winding the rope off of the drum when the switch does not sense the presence (or senses the absence) of the rope at another position in the drum groove, i.e., when it is not desirable to wind more rope off of the drum.

A principal feature of the invention is the provision of a limit switch that is both inexpensive and extremely effective.

Another principal feature of the invention is the provision of a limit switch that can be easily installed on a new hoist or retrofitted on an existing hoist.

Another principal feature of the invention is the reduction of wear because the proximity switch does not contact any moving parts.

Another principal feature of the invention is the provision of a limit switch arrangement with reliable repeatability.

Other features and advantages of the invention will become apparent to those skilled in the art upon review of the following detailed description, claims and drawings.

Figure 1:
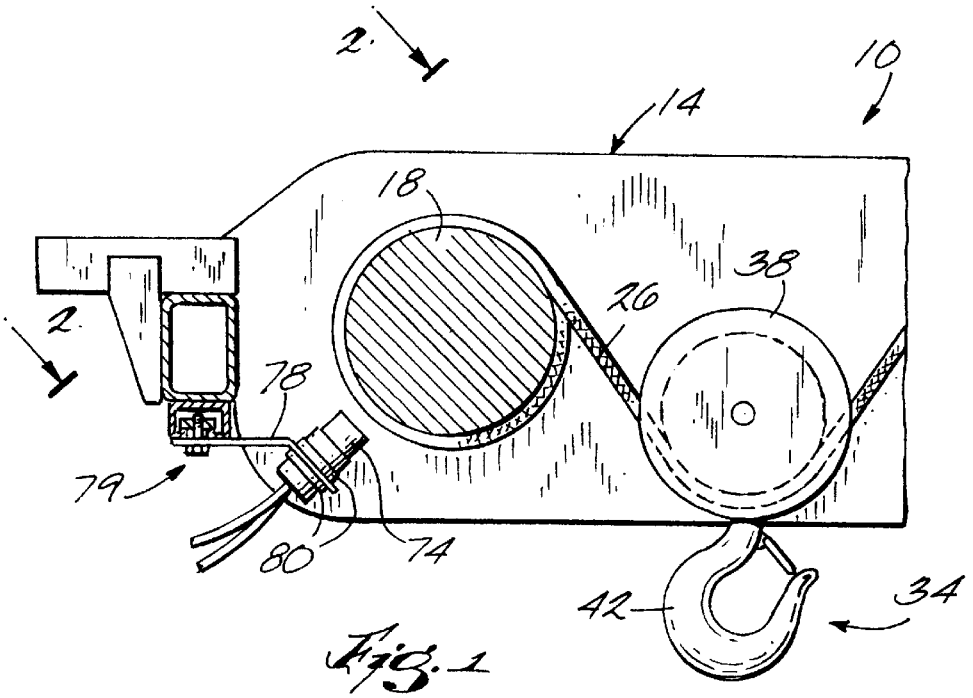
FIG. 1 is a partial vertical sectional I view of a hoist apparatus embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DESCRIPTION OF THE PREFERRED EMBODIMENT

A hoist apparatus 10 embodying the invention is illustrated in the drawings. The apparatus 10 is preferably part of an overhead crane (not otherwise shown) and comprises a frame 14 movable above the ground or the floor of a warehouse or other building in which the crane operates. Such an overhead crane is disclosed in U.S. Pat. No. 5,405,027, which is assigned to the assignee hereof and which is incorporated herein by reference. It should be understood that the hoist apparatus 10 could be a stand-alone hoist.

The hoist apparatus 10 also comprises a hoist drum 18 mounted on the frame 14 for rotation about a generally horizontal drum axis 22. A wire hoist rope 26 is wound around the drum 18 such that the rope 26 winds on to and off of the drum 18 in response to rotation of the drum in opposite wind-up (counterclockwise in FIG. 1) and wind-off (clockwise in FIG. 1) directions, respectively. The ends of the ropes 26 are fixed to the drum 18 adjacent the outer ends of the drum, and the middle portion of the rope 26 passes through an equalizer or upper sheave (not shown) that is fixed to the frame 14 at a point spaced from the drum. The drum 18 has a generally cylindrical outer surface having therein a pair of helical grooves 30, and the portions of the rope 26 adjacent the ends are reeved in respective grooves 30 as the rope winds on to the drum. Each end portion of the rope 26 moves in its groove 30 toward the middle of the drum 18 as the rope winds on to the drum 18. This rope arrangement is known as a double-reeve arrangement. It should be understood that the rope could also have a single-reeve arrangement.

Figure 2:
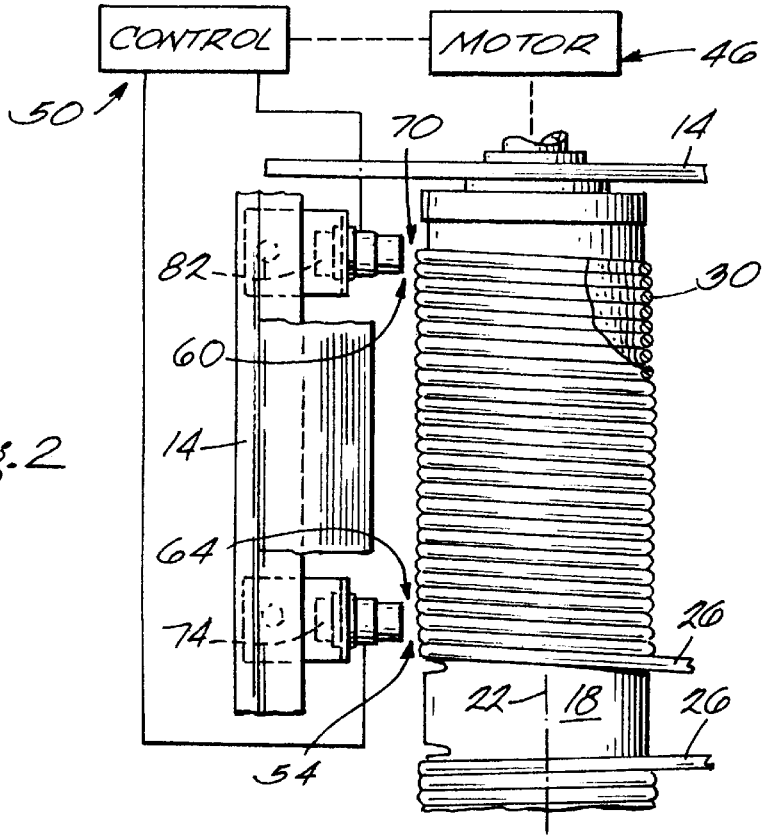
FIG. 2 is a view taken along line 2—2 in FIG. 1.

The hoist apparatus 10 also comprises a load engaging mechanism 34 connected to the rope 26. The load engaging mechanism 34 includes a bottom block 38 through which the rope 26 is reeved, and a hook 42 depending from the bottom block 38. As is known in the art, the load engaging mechanism 34 moves upward when the rope winds on to the drum and moves downward when the rope winds off of the drum. The hoist apparatus 10 also comprises a motor 46 (shown schematically in FIG. 2) that is mounted on the frame 14 and that is connected to the drum 18 for selectively rotating the drum in the opposite wind-up and wind-off directions. A control 50 (shown schematically in FIG. 2) is operably connected to the motor 46 for controlling rotation of the drum. The hoist apparatus 10 as thus far described is conventional and need not be described in greater detail.

The rope 26 has a maximum wind-up point 54 (a point on the rope) beyond which it is not desirable to wind the rope on to the drum 18. This is the point at which the bottom block 38 or a load suspended by the hook 42 comes too close to the frame 14 or the drum 18. The rope 26 also has a maximum wind-off point 60 (a point on the rope) beyond which it is not desirable to wind the rope off of the drum 18. This is the point at which a load suspended by the hook 42 comes too close to the ground or floor, or at which it is not desirable for the rope 26 to pay out further. The maximum wind-up point 54 of the rope is at a certain first point 64 on the drum 18 (or a certain distance from the center of the drum 18), in the groove 30, when the rope is properly wound on to the drum. The maximum wind-off point 60 of the rope 26 is at a certain second point 70 on the drum (or a certain distance from the center of the drum 18), in the groove 30, when the rope is properly wound on to the drum.

The hoist apparatus 10 also comprises a first or upper limit proximity switch 74 mounted on the frame 14 adjacent the first point 64 on the drum, such that the drum moves relative to the switch 74. The proximity switch 74 is a known type of switch that is capable of sensing the presence of the wire rope 26 without touching the rope. A suitable switch is manufactured by Siemens Energy and Automation, Inc., and is sold as Model No. 3RG40 24-0KA00. In the illustrated construction, the switch 74 is mounted on the frame 14 by a mounting bracket 78. Any suitable bracket can be employed. The bracket 78 is preferably a metal plate bent at an angle so as to properly align the switch 74 with the drum 18. The angle will vary with the application, and the appropriate angle can be easily determined by one skilled in the art. One end of the bracket 78 (the left end in FIG. 1) is mounted on the frame 14 so that the position of the bracket 78 along the frame (in the direction in and out of the paper in FIG. 1) is adjustable. The adjustability can be provided by using, for example, a piece of Unistrut and Unistrut nuts (identified generally by reference numeral 79 in FIG. 1) to secure the bracket 78 to the frame 14. The other end of the bracket 78 (the right end in FIG. 1) has therein a circular opening (not shown) in which the switch 74 is mounted, as is known in the art. The position of the switch relative to the bracket 78 and toward and away from the drum 18 is adjusted by adjusting a pair of nuts 80 threaded onto the switch housing and located on opposite sides of the bracket 78. The switch 74 is normally closed (closed when it does not sense anything in its proximity) and opens upon sensing the presence of the rope 26 at the first point 64 on the drum 18, i.e., upon sensing the rope at the maximum wind-up point 54 on the rope. Opening of the switch 74 upon sensing the rope 26 signals the control 50 to prevent the motor 46 from further rotating the drum in the wind-up direction, thereby preventing further lifting of the load.

The hoist apparatus also comprises a second or lower limit proximity switch 82 mounted on the frame 14 adjacent the second point 70 on the drum, such that the drum moves relative to the switch 82. The switch 82 is preferably identical to the switch 74, except as explained below, and is mounted on the frame 14 by a mounting bracket that is substantially identical to the bracket 78. The switch 82 is normally open (open when it does not sense anything in its proximity) and is closed when it senses the presence of the rope 26 at the second point 70 on the drum 18, i.e., when it senses the rope at the maximum wind-off point 60 on the rope (when the rope has not wound off the drum beyond the maximum wind-off point). When the rope winds off the drum beyond the maximum wind-off point, so that the switch 82 does not sense the presence of the rope at the second point 70 on the drum, or senses the absence of the maximum wind-off point 60 on the rope, the switch 82 opens. Opening of the switch 82 signals the control 50 to prevent the motor 46 from further rotating the drum in the wind-off direction, thereby preventing further lowering of the load. The preferred normally-open switch is manufactured by Siemens Energy and Automation, Inc., and is sold as Model No. 3RG40 24-0KB00.

Various features of the invention are set forth in the following claims.

What is claimed is:

1. A hoist apparatus comprising a frame, a hoist drum mounted on the frame for rotation about a drum axis, a motor connected to the drum for selectively rotating the drum in opposite wind-up and wind-off directions about the drum axis, a hoist rope wound around the drum such that the rope winds on to and off of the drum in response to rotation of the drum in the wind-up and wind-off directions, respectively, the rope having a maximum wind-up point beyond which it is not desirable to wind a significant amount of rope on to the drum, and a proximity switch mounted on the frame adjacent the drum such that the drum moves relative to the switch, the switch sensing the presence of the rope without touching the rope, and the switch preventing the motor from rotating the drum in the wind-up direction when the switch senses the presence of the rope on the drum at the maximum wind-up point.

2. A hoist apparatus as set forth in claim 1 and further comprising a control operably connected to the motor, the control controlling rotation of the drum, and wherein the switch signals the control in response to sensing the presence of the rope.

3. A hoist apparatus as set forth in claim 1 wherein the drum has a groove in which the rope is reeved as the rope winds on to the drum, such that the wind-up point of the rope is at a certain point on the drum when the rope is properly wound on to the drum, and wherein the switch is mounted adjacent the point on the drum.

4. A hoist apparatus as set forth in claim 1 wherein the rope is a wire rope.

5. A hoist apparatus as set forth in claim 1 and further comprising a load engaging mechanism connected to the rope such that the load engaging mechanism moves upward when the rope winds on to the drum and moves downward when the rope winds off of the drum.

6. A hoist apparatus as set forth in claim 1 wherein the position of the switch relative to drum is adjustable.

7. A hoist apparatus as set forth in claim 6 and further comprising a bracket mounted on the frame such that the position of the bracket relative to the frame is adjustable in at least one direction, and wherein the switch is mounted on the bracket such that the position of the switch relative to the bracket is adjustable in another direction.

8. A hoist apparatus comprising a frame, a hoist drum mounted on the frame for rotation about a drum axis, a motor connected to the drum for selectively rotating the drum in opposite wind-up and wind-off directions about the drum axis, a hoist rope wound around the drum such that the rope winds on to and off of the drum in response to rotation of the drum in the wind-up and wind-off directions, respectively, the rope having a maximum wind-off point beyond which it is not desirable to wind a significant amount of rope off of the drum, and a proximity switch mounted on the frame adjacent the drum such that the drum moves relative to the switch, the switch sensing the presence of the rope without touching the rope, and the switch preventing the motor from rotating the drum in the wind-off direction when the switch senses the absence of the rope on the drum at the maximum wind-off point.

9. A hoist apparatus as set forth in claim 8 and further comprising a control operably connected to the motor, the control controlling rotation of the drum, and wherein the switch signals the control in response to sensing the absence of the rope.

10. A hoist apparatus as set forth in claim 8 wherein the drum has a groove in which the rope is reeved as the rope winds on to the drum, such that the wind-off point of the rope is at a certain point on the drum when the rope is properly wound on to the drum, and wherein the switch is mounted adjacent the point on the drum.

11. A hoist apparatus as set forth in claim 8 wherein the rope is a wire rope.

12. A hoist apparatus as set forth in claim 8 and further comprising a load engaging mechanism connected to the rope such that the load engaging mechanism moves upward when the rope winds on to the drum and moves downward when the rope winds off of the drum.

13. A hoist apparatus as set forth in claim 8 wherein the position of the switch relative to drum is adjustable.

14. A hoist apparatus as set forth in claim 13 and further comprising a bracket mounted on the frame such that the position of the bracket relative to the frame is adjustable in at least one direction, and wherein the switch is mounted on the bracket such that the position of the switch relative to the bracket is adjustable in another direction.

15. A hoist apparatus comprising a frame, a hoist drum mounted on the frame for rotation about a drum axis, a motor connected to the drum for selectively rotating the drum in opposite wind-up and wind-off directions about the drum axis, a wire hoist rope wound around the drum such that the rope winds on to and off of the drum in response to rotation of the drum in the wind-up and wind-off directions, respectively, the rope having a maximum wind-up point beyond which it is not desirable to wind a significant amount of rope on to the drum and a maximum wind-off point beyond which it is not desirable to wind a significant amount of rope off of the drum, a load engaging mechanism connected to the rope such that the load engaging mechanism moves upward when the rope winds on to the drum and moves downward when the rope winds off of the drum, a first proximity switch mounted on the frame adjacent the drum, such that the drum moves relative to the first switch, the first switch sensing the presence of the rope without touching the rope, and the first switch preventing the motor from rotating the drum in the wind-up direction when the first switch senses the presence of the rope on the drum at the maximum wind-up point, and a second proximity switch mounted on the frame adjacent the drum, such that the drum moves relative to the second switch, the second switch sensing the presence of the rope without touching the rope, and the second switch preventing the motor from rotating the drum in the wind-off direction when the second switch does not sense the presence of the rope on the drum at the maximum wind-off point.

16. A hoist apparatus as set forth in claim 15 and further comprising a control operably connected to the motor, the control controlling rotation of the drum, wherein the first switch signals the control in response to sensing the presence of the rope, and wherein the second switch signals the control in response to not sensing the presence of the rope.

17. A hoist apparatus as set forth in claim 15 wherein the drum has a groove in which the rope is reeved as the rope winds on to the drum, such that the wind-up point of the rope is at a certain first point on the drum when the rope is properly wound on to the drum, and such that the wind-off point of the rope is at a certain second point on the drum when the rope is properly wound on to the drum, wherein the first switch is mounted adjacent the first point on the drum, and wherein the second switch is mounted adjacent the second point on the drum.

18. A hoist apparatus as set forth in claim 15 wherein the position of the first switch relative to drum is adjustable, and wherein the position of the second switch relative to drum is adjustable.

19. A hoist apparatus as set forth in claim 18 and further comprising a first bracket mounted on the frame such that the position of the first bracket relative to the frame is adjustable in at least one direction, and a second bracket mounted on the frame such that the position of the second bracket relative to the frame is adjustable in the at least one direction, wherein the first switch is mounted on the first bracket such that the position of the first switch relative to the first bracket is adjustable in another direction, and wherein the second switch is mounted on the second bracket such that the position of the second switch relative to the second bracket is adjustable in the other direction, the first and second switches being movable relative to each other.

* * * * *